US012195933B2

(12) United States Patent
Anson

(10) Patent No.: US 12,195,933 B2
(45) Date of Patent: Jan. 14, 2025

(54) ROAD SURFACE MATTING

(71) Applicant: Anthony Anson, Auckland (NZ)

(72) Inventor: Anthony Anson, Auckland (NZ)

( * ) Notice: Subject to any disclaimer, the term of this patent is extended or adjusted under 35 U.S.C. 154(b) by 730 days.

(21) Appl. No.: 17/432,934

(22) PCT Filed: Apr. 14, 2020

(86) PCT No.: PCT/NZ2020/050035

§ 371 (c)(1),
(2) Date: Aug. 22, 2021

(87) PCT Pub. No.: WO2020/214038

PCT Pub. Date: Oct. 22, 2020

(65) Prior Publication Data

US 2022/0162809 A1 May 26, 2022

(30) Foreign Application Priority Data

Apr. 17, 2019 (NZ) ..... 752734
Jul. 4, 2019 (NZ) ..... 755145

(51) Int. Cl.
*E01C 5/00* (2006.01)
*E01C 5/14* (2006.01)
*E01C 9/08* (2006.01)

(52) U.S. Cl.
CPC ..... *E01C 5/005* (2013.01); *E01C 5/14* (2013.01); *E01C 9/086* (2013.01); *E01C 2201/165* (2013.01)

(58) Field of Classification Search
CPC . E01C 5/005; E01C 5/14; E01C 9/086; E01C 2201/165
See application file for complete search history.

(56) References Cited

U.S. PATENT DOCUMENTS 2,335,556 A * 11/1943 Wilson ..... E01C 5/14 404/36
3,592,420 A * 7/1971 Reiter ..... E21D 11/152 404/43
6,474,029 B1 * 11/2002 Cook ..... E04H 17/1602 52/223.7
2002/0122954 A1 * 9/2002 Dagher ..... B32B 21/08 428/528
2006/0222804 A1 * 10/2006 Banting ..... E01C 9/086 428/54
2013/0051911 A1 * 2/2013 Corser ..... E01C 9/086 404/35
2013/0259568 A1 * 10/2013 Bouchard ..... E01C 9/086 404/35

(Continued)

*Primary Examiner* — Abigail A Risic
(74) *Attorney, Agent, or Firm* — Gloria Tsui-Yip; Gottlieb, Rackman & Reisman, P.C.

(57) ABSTRACT

A problem with unpaved roads is that they can be prone to damage when driven on. The road surface matting includes a first mat 1*a* and a second mat 1*b*, each mat having a series of substantially parallel beams 2, a plurality of spine rods 3 that run substantially perpendicular to and through the beams and connect the beams to one another. Each mat also has a joiner 7 adjacent an edge of the mat, arranged so that one of the spine rods passes through the joiner. The matting is such that the first and second mats are connected to one another by way of a connecting rod 8 that passes through and joiner 8 of one mat and the joiner 8 of the other mat.

12 Claims, 5 Drawing Sheets

(56) References Cited

U.S. PATENT DOCUMENTS

| | | | | |
|---|---|---|---|---|
| 2015/0056013 | A1* | 2/2015 | Brown | E01C 5/005 404/35 |
| 2017/0137999 | A1* | 5/2017 | Rosier | E01C 9/08 |
| 2019/0136503 | A1* | 5/2019 | Brown, Jr. | E04B 1/2403 |
| 2020/0157747 | A1* | 5/2020 | Penland, Jr. | E01C 5/20 |

* cited by examiner

ROAD SURFACE MATTING

FIELD OF THE INVENTION

This invention relates to matting for use in providing a road surface.

BACKGROUND

It is known to overlay the ground with mats to make a better surface for vehicles to drive on, for example in unpaved areas where vehicles would otherwise have to travel over an inadequate ground surface. US patent specification No. 2006/0222804 by Banting discloses a road matting where, among other things, a series of beams are arranged in parallel, each within its own pocket in a fabric mat. The manner in which the Banting mat is constructed places inordinate reliance on the fabric, which makes it vulnerable to wear and tear. It is an object of the present invention to go at least some way towards providing a useful alternative.

DEFINITIONS

The terms "comprising" or "having", if and when used in relation to one or more features, in each case indicates minimum features present but does not rule out the option of there being further features that are not mentioned. The same applies to derivative words, for example "comprises", etc.

SUMMARY OF THE INVENTION

According to one aspect of the invention there is provided road surface matting, comprising a first mat and a second mat, each mat having:

- a series of substantially parallel beams (e.g. bamboo beams);
- a plurality of spine rods that:
  - run substantially perpendicular to and through the beams; and
  - connect the beams to one another; and
- a joiner (e.g. a locking plate) adjacent an edge of the mat arranged so that one of the spine rods passes through the joiner; and wherein the matting is such that the first and second mats are connected to one another by way of a connecting rod that passes through and connects the joiner of one mat to the joiner of the other mat.

Optionally the spine rods and the connecting rod are substantially parallel to one another.

Optionally at least some of the beams of each mat are glued to one another.

Optionally the joiners are able to pivot with respect to the spine rod and the connecting rod.

Optionally the beams comprise bamboo, eg hot pressed strand woven bamboo.

Optionally the connecting rod is arranged at the corner of each of four of the mats and each mat is connected to the connecting rod by its joiner (eg locking plate).

Optionally the joiner of each mat extends outwards from its associated spine rod between two beams of the same mat.

Optionally the connecting rod is located in a space between the beams of adjacent mats.

DRAWINGS

Some preferred embodiments of the invention will now be described by way of example and with reference to the accompanying drawings, of which:

Figure 5:
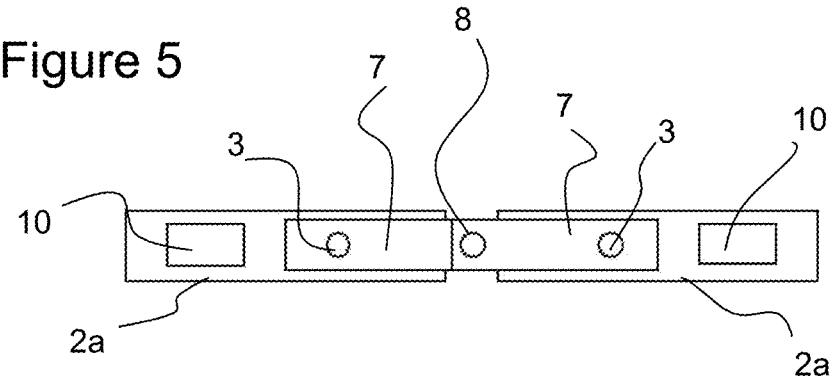
Figure 6:
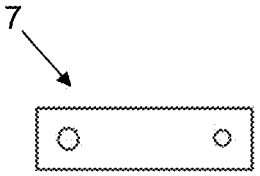
Figure 7:
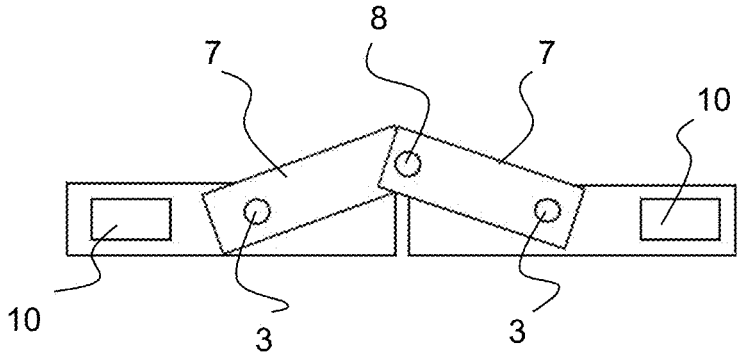
Figure 8:
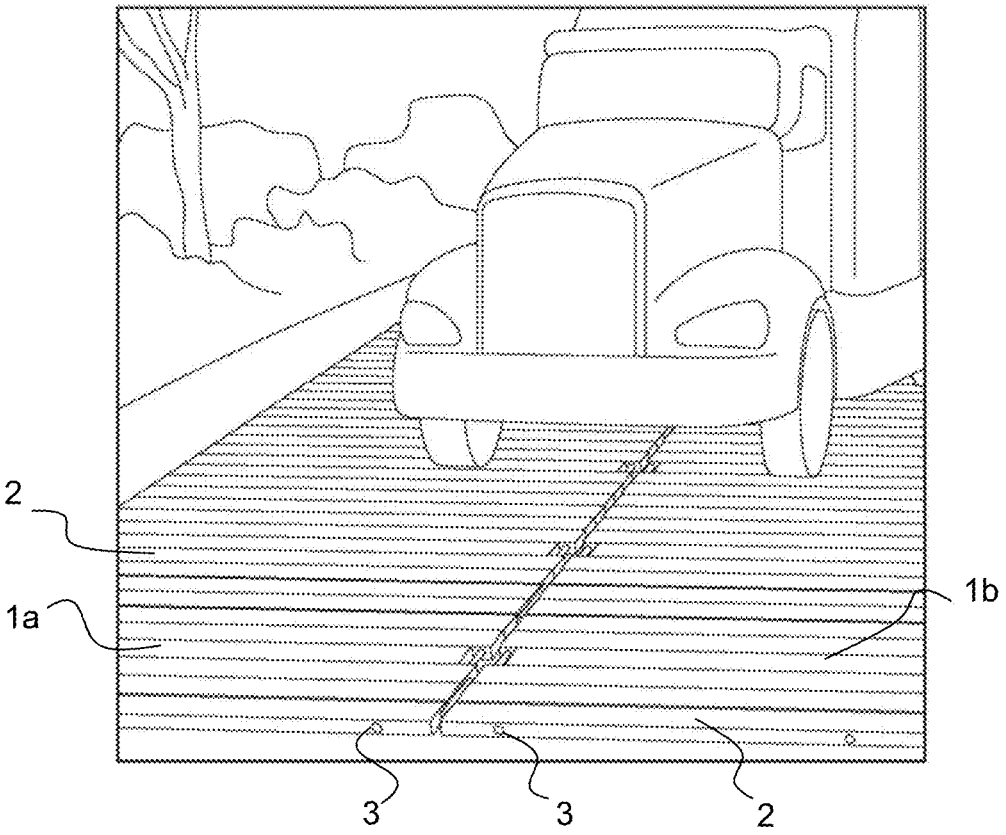
Figure 9:
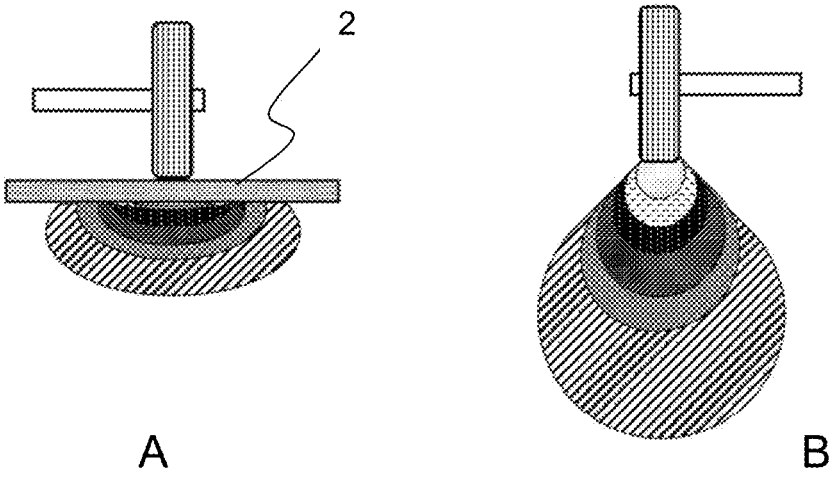

FIG. 5 provides detail of the manner in which the mats may be connected;

FIG. 6 illustrates a joiner plate forming part of the mat;

FIG. 7 illustrates the manner in which joiner plates may move;

FIG. 8 illustrates a road formed in part by combing a number of the mats; and FIG. 9 illustrates the manner in which the mats dissipate load.

DETAILED DESCRIPTION

Figure 1:
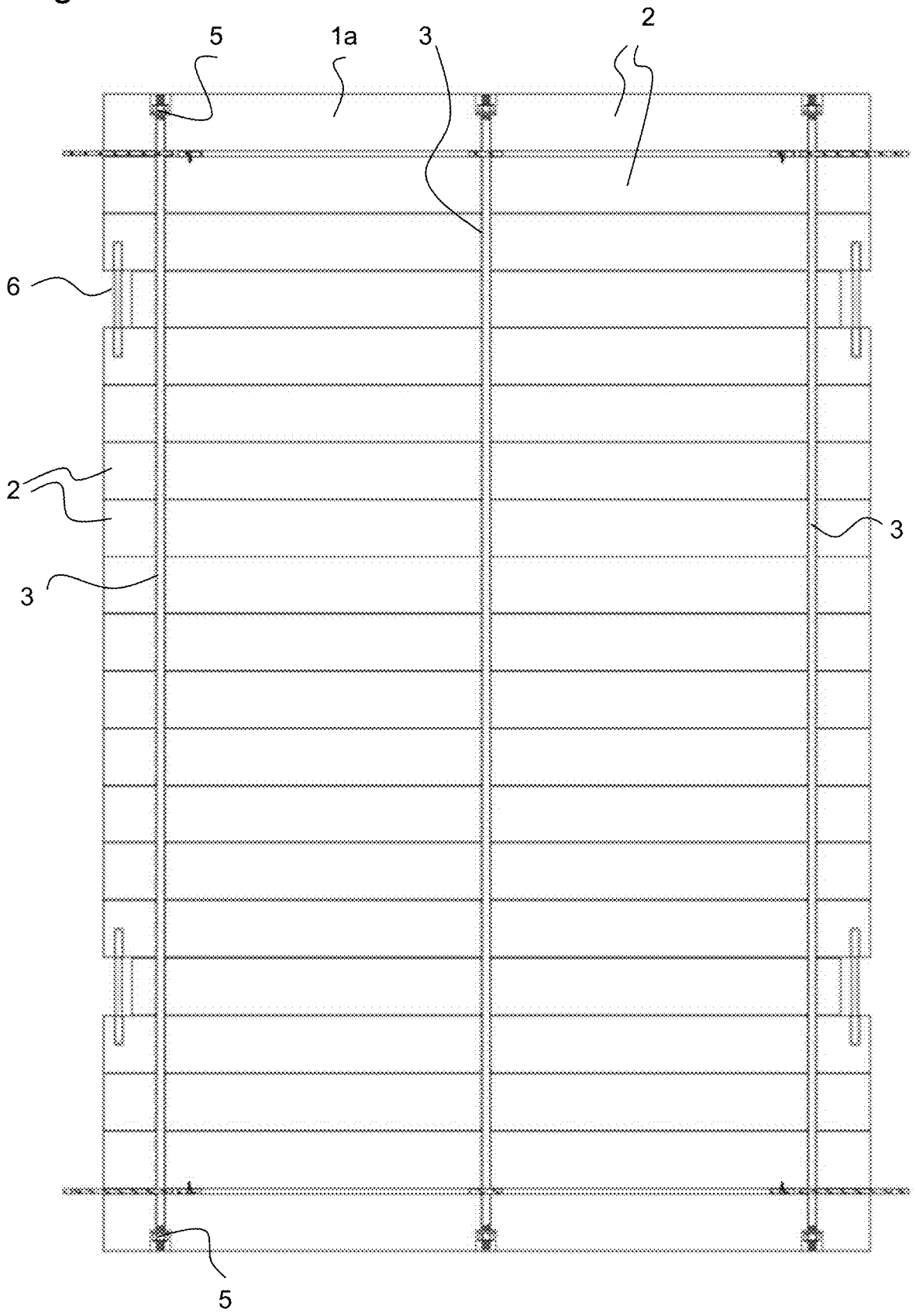
FIG. 1 is a cross-sectional plan view of a mat used as a road overlay.

Referring to FIG. 1, the mat la has a series of beams 2 arranged in parallel. In this example the beams 2 are glued in sets of two or four, and are connected and tensioned by a series of spine rods 3 running perpendicular to and through the beams 2. As shown, the ends of each spine rod 3 are recessed in the end beams and are held there by lock nuts 5. Handles 6 are set into side recesses to provide grips for carrying the mat if need be.

Figure 2:
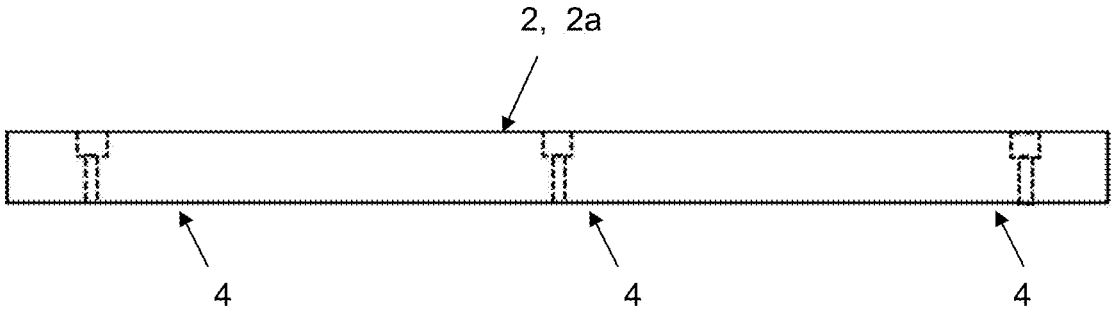
FIG. 2 is a cross-sectional side view of an end beam forming part of the mat.
Figure 3:
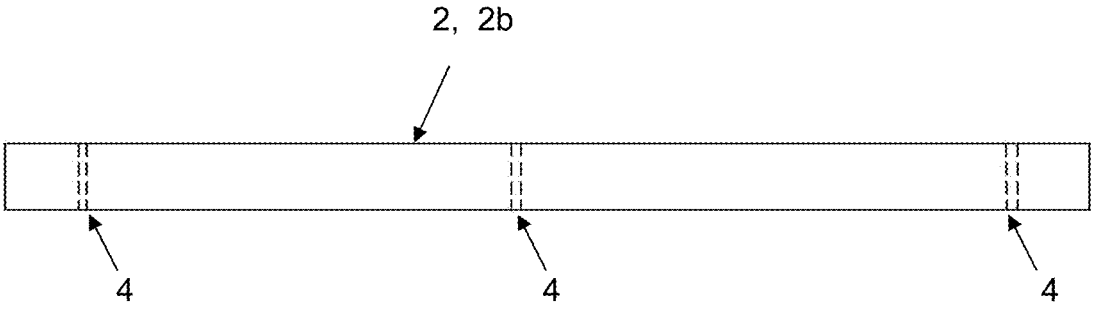
FIG. 3 is a cross-sectional side view of a central beam forming part of the mat.

FIG. 2 illustrates detail one of the beams 2*a* at the end of the mat, and FIG. 3 illustrates detail of one of the beams 2*b* in a central part of the mat. The beams are such that the spine rods 3 pass through the holes 4 indicated by dotted lines.

Figure 4:
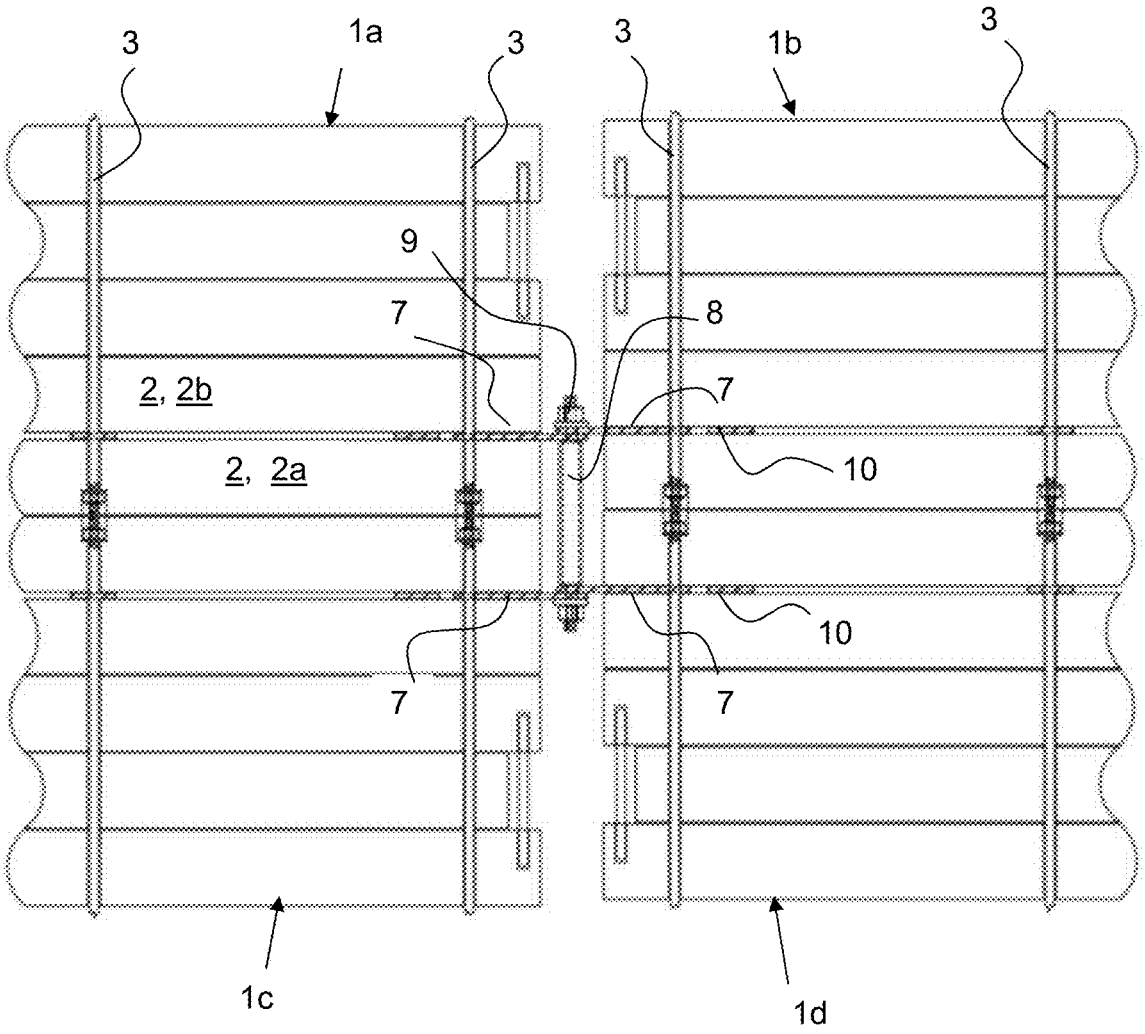
FIG. 4 illustrates the manner in which the mat may be combined with other such mats.

FIG. 4 illustrates how four of the mats 1*a-d* are joined 'side to side' and 'end to end'. As shown, the spine rods 3 at adjacent corners of the mats 1*a*, 1*b* are joined to one another by way of locking plates 7 and a central connecting rod 8 with bolts 9 at each end. The spine rods 3 at adjacent corners of the mats 1*c*, 1*d* are also joined to the connecting rod 8 in the same way.

More specifically, and referring to FIG. 5, the locking plates 7 have a hole at each end. In each case the associated spine rod 3 passes through one of these holes, and the central connecting rod 8 passes through the other hole. As also shown, the sides of the beams have spacer plates 10 between adjacent end beams 2*a* next to the locking plates 7. One of the locking plates 7 is shown in more detail in FIG. 6.

As illustrated in FIG. 7, the locking plates 7 are able to pivot about the associated spine rod 3 as well as the connecting rod 8. This means there is a degree of 'give' between the mats.

Referring to FIG. 8, when in use the mats 1*a-d* are joined to one another as above, for example so that together they extend from one side of a dirt road to the other. Additional such mats are added in front of, and also behind, the set 1*a-d* in the same way to extend, in repeating fashion, over and along unpaved or otherwise inadequate ground to provide a surface for vehicles to drive on.

The matting spreads or dissipates heavy loads across one or more of the beams 2. This protects the underlying ground against point loading that would otherwise cause rutting or other damage to the ground. FIG. 9 illustrates the force distribution of weight from a vehicle wheel with (A) and then without (B) the matting. The downward force is significantly more spread at the ground surface at A than it is at B.

Further, when the underlying surface is boggy, the matting provides vehicles with improved wheel grip.

The matting can be particularly useful for providing temporary road or other surfaces, but can also be used for permanent surfaces. It may be used to provide enhanced access to vehicles in the context of construction or civil works in remote or hard to access areas generally, for example at mining sites or where electrical power lines are being installed. The matting can also be used to provide walking surfaces to prevent work areas attended by people on foot from becoming boggy. By adding mats as desired, sideways and longways, one can make a road or other surface as long or wide as need be. Damaged or worn sections can be easily repaired, or example by replacing the beams or other components as need be.

Preferably the beams are in each case strand woven hot pressed bamboo, for example Mao bamboo. Each mat is preferably about 2,000 mm wide, 3,000 mm long and 70 mm thick and has a compression density of about 1,050-1,200 $kg/m^3$. However other dimensions and compression densities can be used depending on the target end use. In some embodiments of the mat each beam 2 may be 140 mm wide, 2,000 mm long and 70 mm thick. Preferably each mat has three of the spine rods 3, but the number used may depend on the overall dimensions of the mat.

While some preferred embodiments of the invention have been described by way of example it should be appreciated that modifications and improvements can occur without departing from the scope of the following claims.

In terms of disclosure, this document hereby discloses each item, feature or step mentioned herein in combination with one or more of any of the other item, feature or step disclosed herein, in each case regardless of whether such combination is claimed.

The invention claimed is:

1. Road surface matting, comprising a first mat and a second mat, each mat having:

a series of substantially parallel beams;

a plurality of spine rods that:

run substantially perpendicular to and through the beams; and connect the beams to one another; and a joiner adjacent an edge of the mat arranged so that one of the spine rods passes through the joiner; and wherein the matting is such that the first and second mats are connected to one another by way of a connecting rod that passes through and connects the joiner of one mat to the joiner of the other mat, wherein the spine rods and the connecting rod are substantially parallel to one another, and wherein the joiners are able to pivot with respect to their associated spine rod and the connecting rod.

2. Road surface matting according to claim 1, wherein each joiner comprises a locking plate.

3. Road surface matting according to claim 1, wherein at least some of the beams of each mat are glued to one another.

4. Road surface matting according to claim 1, wherein the beams comprise bamboo.

5. Road surface matting according to claim 1, wherein the beams comprise hot pressed strand woven bamboo.

6. Road surface matting according to claim 1, wherein the connecting rod is arranged at the corner of each of four of the mats and each mat is connected to the connecting rod by its joiner.

7. Road surface matting according to claim 1, wherein the joiner of each mat extends outwards from its associated spine rod between two beams of the same mat.

8. Road surface matting according to claim 1, wherein the connecting rod is located in a space between the beams of adjacent mats.

9. Road surface matting according to claim 1, wherein:

a) there are at least four of the mats;

b) each mat is connected to the connecting rod by its joiner, the joiner in each case being in the form locking bar;

c) each locking bar extending outwards from its associated spine rod between two beams of the same mat; and d) the beams comprise bamboo.

10. A ground surface overlaid with matting according to claim 9 arranged to provide a road for vehicles.

11. A mat for road surface matting, the mat having:

a series of substantially parallel beams;

a plurality of spine rods that:

run substantially perpendicular to and through the beams; and connect the beams to one another;

a connecting rod; and a joiner adjacent an edge of the mat arranged so that one of the spine rods passes through the joiner;

wherein the mat is such that it is able to be connected to another mat the same, by way of the connecting rod passing through and connecting the joiner of one mat to the joiner of the other mat, wherein the spine rods and the connecting rod are substantially parallel to one another, and wherein the joiners are able to pivot with respect to their associated spine rod and the connecting rod.

12. A road surface comprising a plurality of mats according to claim 11 wherein the mats are connected to one another in the manner set out in that claim.

* * * * *